US008590312B2

(12) United States Patent
Sandelis

(10) Patent No.: US 8,590,312 B2
(45) Date of Patent: Nov. 26, 2013

(54) DEVICE FOR INJECTING A MIXTURE OF AIR AND FUEL INTO A TURBOMACHINE COMBUSTION CHAMBER

(75) Inventor: Denis Jean Maurice Sandelis, Nangis (FR)

(73) Assignee: SNECMA, Paris (FR)

( * ) Notice: Subject to any disclaimer, the term of this patent is extended or adjusted under 35 U.S.C. 154(b) by 144 days.

(21) Appl. No.: 13/143,357

(22) PCT Filed: Oct. 1, 2009

(86) PCT No.: PCT/FR2009/001175

§ 371 (c)(1),
(2), (4) Date: Jul. 6, 2011

(87) PCT Pub. No.: WO2010/081940

PCT Pub. Date: Jul. 22, 2010

(65) Prior Publication Data

US 2011/0271682 A1 Nov. 10, 2011

(30) Foreign Application Priority Data

Jan. 16, 2009 (FR) ..... 09 00195

(51) Int. Cl.
*F02C 1/00* (2006.01)

(52) U.S. Cl.
USPC ..... 60/748; 60/740

(58) Field of Classification Search
USPC ..... 60/740, 742, 746, 747, 748, 737, 60/752–760
See application file for complete search history.

(56) References Cited

U.S. PATENT DOCUMENTS

| | | | | |
|---|---|---|---|---|
| 3,121,996 | A * | 2/1964 | Smith | 60/748 |
| 3,808,803 | A | 5/1974 | Salvi | |
| 5,351,489 | A * | 10/1994 | Okamoto et al. | 60/740 |
| 7,065,972 | B2 * | 6/2006 | Zupanc et al. | 60/748 |
| 7,908,865 | B2 | 3/2011 | Cayre et al. | |
| 2007/0113556 | A1 | 5/2007 | Biebel et al. | |
| 2007/0227147 | A1 | 10/2007 | Cayre et al. | |
| 2008/0168773 | A1 | 7/2008 | Sandelis | |
| 2009/0049840 | A1 | 2/2009 | Cayre et al. | |
| 2009/0151357 | A1 | 6/2009 | Pieussergues et al. | |

FOREIGN PATENT DOCUMENTS

| | | |
|---|---|---|
| EP | 1 785 671 | 5/2007 |
| EP | 1 840 467 | 10/2007 |
| EP | 2 014 988 | 1/2009 |

OTHER PUBLICATIONS

International Search Report Issued Jun. 23, 2010 in PCT/FR09/001175 filed Oct. 1, 2009.

* cited by examiner

*Primary Examiner* — Ehud Gartenberg
*Assistant Examiner* — Vikansha Dwivedi
(74) *Attorney, Agent, or Firm* — Oblon, Spivak, McClelland, Maier & Neustadt, L.L.P.

(57) ABSTRACT

A device for injecting a mixture of air and fuel into a turbomachine combustion chamber includes a centering ring for centering an injector and a primary swirler situated downstream from the ring, the ring including axial air-passing orifices and the swirler including curved air-passing channels, a number of orifices in the ring being no greater than a number of channels in the swirler, and downstream outlets of the orifices in the ring being situated between the channels in the swirler.

16 Claims, 3 Drawing Sheets

DEVICE FOR INJECTING A MIXTURE OF AIR AND FUEL INTO A TURBOMACHINE COMBUSTION CHAMBER

BACKGROUND OF THE INVENTION

1. Field of the Invention

The present invention relates to a device for injecting a mixture of air and fuel into a combustion chamber of a turbomachine, such as an airplane turboprop or turbojet.

2. Description of the Related Art

An injection device of this type generally includes primary and secondary swirlers that are disposed downstream from an injector, coaxially therewith, each of which delivers radial streams of air downstream from the fuel injector so as to mix the air and the fuel that is to be injected and then burnt in the combustion chamber. The flow of air from the primary swirler is accelerated in a Venturi that is interposed between the two swirlers. A bowl of frustoconical shape is mounted downstream from the swirlers and guides the air/fuel mixture that enters into the combustion chamber.

Each swirler has a plurality of substantially radial vanes defining between them curved or inclined air-passing channels so as to impart rotary motion to the air about the axis of the swirler, thereby forming a swirling stream of air.

The head of the fuel injector is axially engaged in a centering ring that is mounted to slide radially in a bushing situated upstream from the swirlers so as to accommodate differential thermal expansions between the various parts in operation. The ring includes axial air-passing orifices that open out radially inside the primary swirler. The orifices in the ring are situated on a circumference of a diameter that is smaller than the diameter of circumference passing via the radially inner trailing edges of the vanes of the swirler.

In the prior art, the number of orifices in the ring and the number of vanes in the primary swirler are determined independently of each other. Nevertheless, the air streams leaving the orifices in the ring disturb the swirling air stream delivered by the primary swirler, thereby giving rise to turbulence in the swirling air stream that can give rise to soot and coke being deposited on the inside surface of the Venturi.

This deposit may impede injection of the air/fuel mixture into the chamber and may give rise to local hot points inside the chamber, thereby in particular encouraging the emission of harmful gases such as nitrogen oxides (NOx).

BRIEF SUMMARY OF THE INVENTION

A particular object of the present invention is to provide a solution to these problems of the prior art that is simple, effective, and inexpensive.

To this end, the invention provides a device for injecting a mixture of air and fuel into a turbomachine combustion chamber, the device including a centering ring for centering a fuel injector, a Venturi situated downstream from the injector and coaxially therewith, and a primary swirler situated between the ring and the Venturi, the swirler having substantially radial vanes defining curved air-passing channels between one another, and the ring including substantially axial air-passing orifices opening out radially inside the swirler, the device being characterized in that the number of orifices in the ring is no greater than the number of vanes in the swirler, and in that the downstream outlets of the orifices in the ring are situated between the channels of the swirler so that the air streams leaving the orifices in the ring do not disturb the air streams delivered by the swirler.

According to the invention, the number of orifices in the injector centering ring is determined as a function of the number of vanes in the primary swirler, the number of these orifices being no greater than the number of the vanes. Each orifice in the ring is associated with a vane of the swirler and is positioned between two channels, thereby limiting the formation of coke on the inside surface of the Venturi.

The number of orifices in the ring may lie in the range six to 18. The orifices in the ring may have a diameter lying in the range 0.2 millimeters (mm) to 2 mm, and for example in the range 0.5 mm to 1 mm.

Preferably, the thickness of material in the transverse or circumferential direction between the outlets of the channels in the swirler is greater than the diameter of the orifices in the ring and may lie in the range approximately 1.5 to 2 times the diameter of the orifices in the ring.

The orifices in the ring may extend parallel to the axis of the ring or are inclined relative to said axis. For example, the orifices in the ring are inclined radially in such a manner as to converge or diverge relative to one another going from upstream to downstream. In a variant, or as an additional characteristic, these orifices may be inclined in a tangential or circumferential direction so that the air streams passing through the orifices are oriented in the same direction of rotation as the air streams delivered by the swirler, or in the opposite direction of rotation.

Advantageously, the device of the invention includes means for preventing the ring from turning about its axis relative to the bushing.

These blocking means serve to keep the ring in the same position relative to the bushing and the swirler, and thus to maintain the relative position between the orifices in the ring and the outlets from the channels in the swirler. The ring can slide radially inside the bushing to accommodate differential thermal expansions of the parts in operation, without modifying its angular position about its axis.

The invention also provides a turbomachine such as an airplane turboprop or turbojet, the turbomachine being characterized in that it includes a combustion chamber fitted with at least one device as described above for injecting a mixture of air and fuel.

BRIEF DESCRIPTION OF THE SEVERAL VIEWS OF THE DRAWINGS

The invention can be better understood and other characteristics, details, and advantages thereof appear more clearly on reading the following description made by way of non-limiting example and with reference to the accompanying drawings, in which.

DETAILED DESCRIPTION OF THE INVENTION

Figure 1:
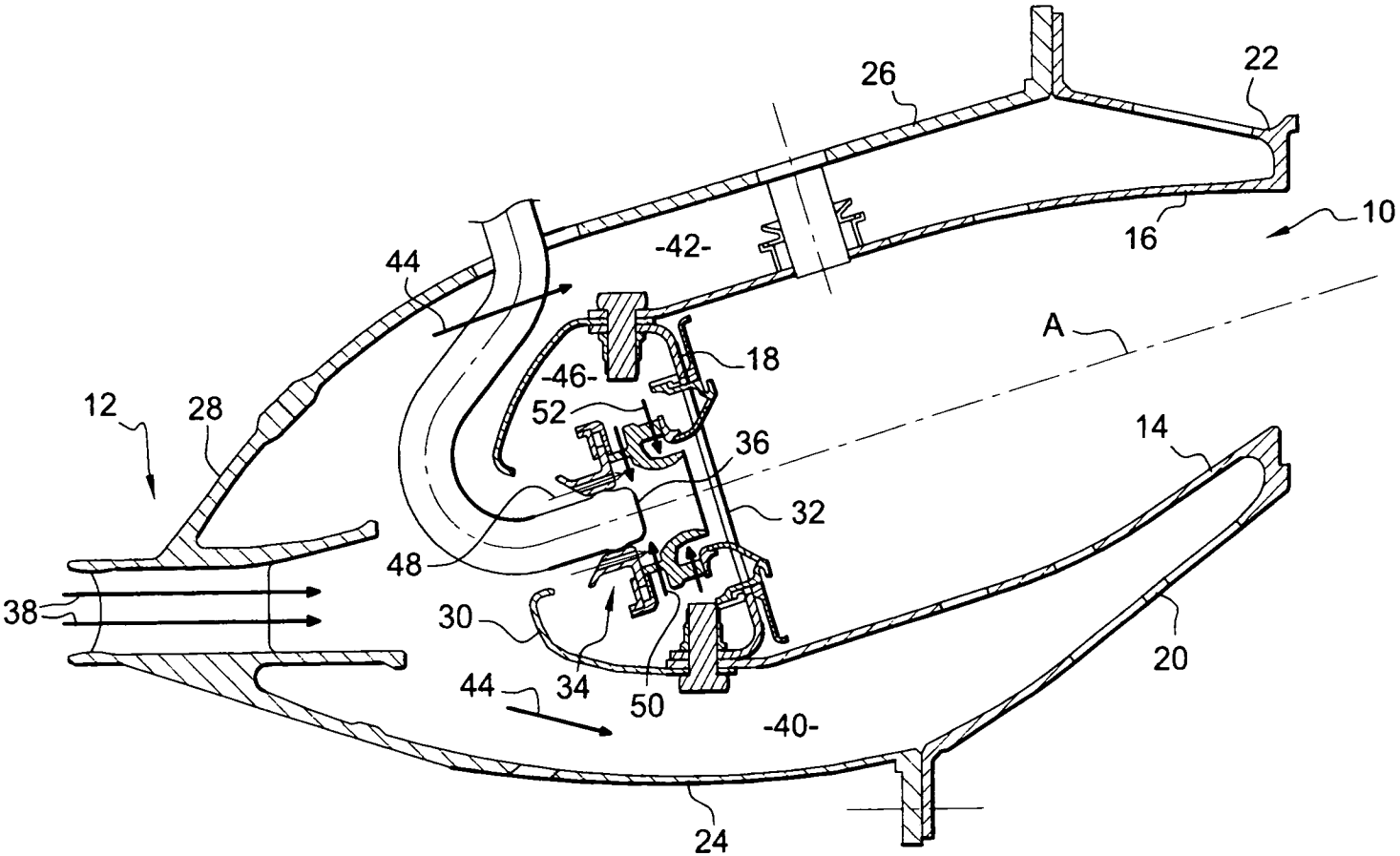
FIG. 1 is a diagrammatic half-view in axial section of a diffuser and a combustion chamber in a turbomachine.

FIG. 1 shows an annular combustion chamber 10 of a turbomachine such as an airplane turboprop or turbojet, the chamber being arranged at the outlet from a diffuser 12, itself situated at the outlet from a compressor (not shown). The chamber 10 has an inner wall 14 forming a surface of revolution and an outer wall 16 also forming a surface of revolution, which walls are connected together at their upstream ends by an annular chamber end wall 18, and they are fastened at their downstream ends by inner and outer flanges 20 and 22 respectively to an inner frustoconical web 24 of the diffuser and to an outer casing 26 of the chamber, the upstream end of the casing 26 being connected to an outer frustoconical web 28 of the diffuser.

An annular fairing 30 is fastened to the upstream ends of the walls 14, 16, and 18 of the chamber and includes air-passing orifices in alignment with openings 32 in the chamber end wall 18 that have devices 34 mounted therein for injecting a mixture of air and fuel into the chamber, the air coming from the diffuser 12, and the fuel being delivered by injectors fastened to the outer casing 26 and regularly distributed around the axis of the chamber. Each injector has a fuel injection head 36 in alignment on the axis of the corresponding opening 32.

A fraction of the air flow 38 delivered by the compressor and leaving the diffuser 12 is fed to inner and outer annular ducts 40 and 42 bypassing the combustion chamber 10 (arrows 44). The remainder of the air flow penetrates into the annular enclosure 46 defined by the fairing 30, passes into the injector device 34 (arrows 48, 50, and 52) and is subsequently mixed with the fuel delivered by the injector and sprayed into the combustion chamber 10.

Figure 2:
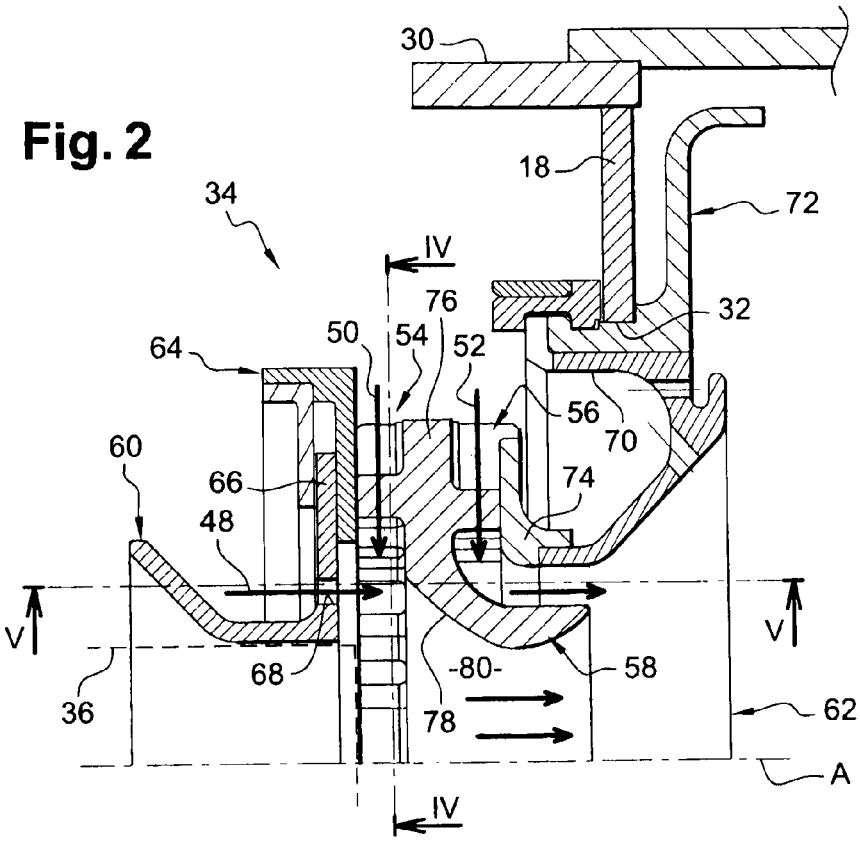
FIG. 2 is a fragmentary view of FIG. 1 on a larger scale and shows a prior art device for injecting a mixture of air and fuel.
Figure 3:
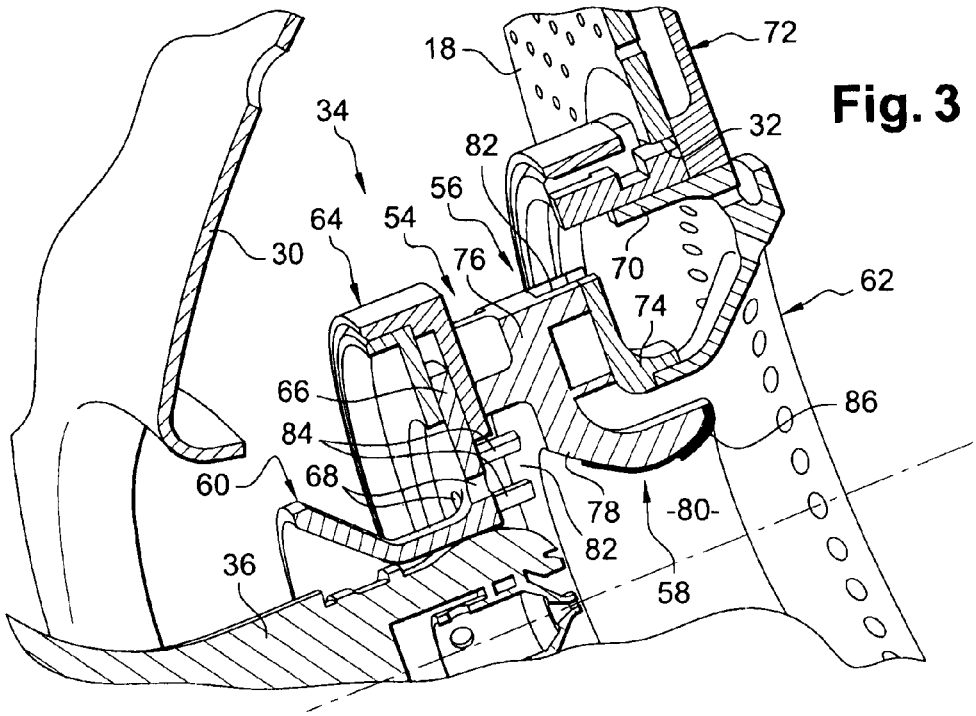
FIG. 3 is a fragmentary diagrammatic view in perspective and in axial section showing the device of FIG. 2.

The injector device 34, more clearly seen in FIGS. 2 and 3, includes coaxial upstream and downstream swirlers 54 and 56 that are spaced apart from each other by a Venturi 58 and that are connected upstream to means 60 for centering and guiding the head 36 of the injector, and downstream to a mixer bowl 62 that is mounted axially in the opening 32 of the chamber end wall 18.

Each swirler 54, 56 has a plurality of vanes extending substantially radially around the axis A of the swirler and regularly distributed around said axis in order to deliver respective swirling air streams 50 and 52 downstream from the injection head 36. Between them, the vanes define air-passing channels that are inclined or curved around the axis of the swirlers.

The guide means of the injection head 36 comprise a ring 60 having the injection head 36 passing axially therethrough and slidably mounted in a bushing 64 that is fastened to the primary swirler 54. The ring 60 includes an annular rim 66 extending radially outwards and received in an annular groove of the bushing 64, the inside diameter of the groove in the bushing 64 being greater than the outside diameter of the rim 66 of the ring 60.

The rim 66 of the ring 60 includes substantially axial orifices 68 for passing air. The orifices 68 are situated on a circumference centered on the axis A of the ring, the diameter of this circumference being less than the diameter of a circumference passing via the outlets 82 of the channels in the primary swirler 54 so that the air streams 48 leaving the orifices 68 pass axially from upstream to downstream radially inside the swirler 54.

The mixer bowl 62 has a substantially frustoconical wall that flares downstream and that is connected at its downstream end to a cylindrical rim 70 extending upstream and mounted axially in the opening 32 of the chamber end wall 18 with an outer annular deflector 72. The upstream end of the frustoconical wall of the bowl 62 is connected to an intermediate annular part 74 fastened to the secondary swirler 56.

The Venturi 58 has a substantially L-shaped section and, at its upstream end, it includes an outer mounting rim 76 extending radially outwards, which rim is interposed axially between the two swirlers 54 and 56 and co-operates axially with the bushing 64 situated upstream to define the annular passage for the air stream 50 in the primary swirler 54, and with the annular part 74 situated downstream to define the annular passage for the air stream 52 in the secondary swirler 56. The Venturi 58 extends axially downstream inside the secondary swirler 56 and separates the air flow coming from the upstream and downstream swirlers 54 and 56.

The Venturi 58 has an inside cylindrical surface 78 presenting a throat and defining a pre-mixing chamber 80 in which a fraction of the ejected fuel mixes with the air stream 50 delivered by the primary swirler 54. This pre-mixture of air and fuel subsequently mixes downstream from the Venturi with the air stream 52 coming from the secondary swirler 56 so as to form a cone of sprayed fuel inside the chamber.

Nevertheless, the air streams 48 leaving the orifices 68 disturb the air streams 50 leaving the channels of the primary swirler 54, thereby generating turbulence and slowing down the flow, thus encouraging coke 86 to form on the surface 78 of the Venturi 58 (FIG. 3).

The invention enables this problem to be remedied by the fact that the number of orifices 68 in the ring 60 is no greater than the number of vanes in the primary swirler 54 and that these orifices 68 open out between the channels of the swirler 54 so that the air passing via these orifices does not disturb the flows of air at the outlet from the channels of the swirler.

The number of orifices 68 in the ring that is less than or equal to the number of vanes in the primary swirler 54 lies in the range six to 18, and for example in the range six to 12.

Figure 4:
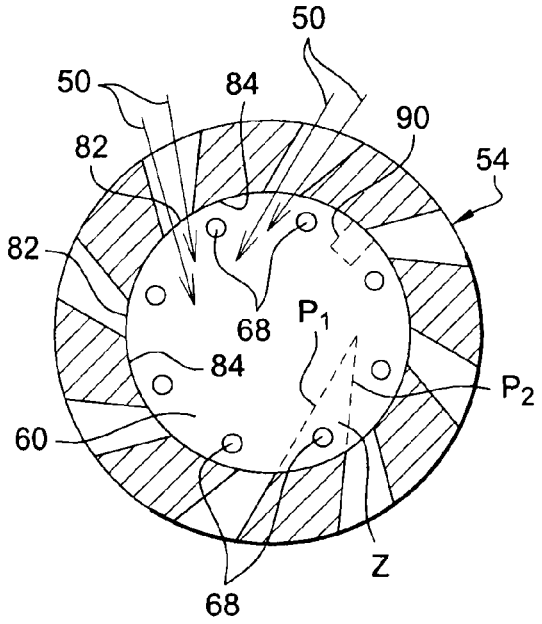
FIG. 4 is a fragmentary and highly diagrammatic view in cross-section of a device of the invention for injecting a mixture of air and of fuel.

According to the invention, each of these orifices 68 is positioned so that its downstream outlet is situated in the vicinity of the trailing edge 84 of a vane of the swirler 54 and inwardly and upstream in line with the vane or at least with its radially inner end portion, as shown in FIG. 4. Each orifice 68 preferably opens out into a zone Z defined by two planes P1 and P2 that are tangential respectively to the pressure side and to the suction side of a vane of the swirler 54.

FIG. 4 is a highly diagrammatic section view of a device of the invention, the section being on a line IV-IV of the device (see FIG. 2 where said line is positioned relative to a prior art device).

The air 48 leaving the orifices 68 of the ring is thus injected at the trailing edges 84 of the vanes of the swirler 54 and flows substantially along said trailing edges to the Venturi 58 where it forms a film of anti-coking air on the inside surface 78 thereof. As described in greater detail below with reference to FIGS. 5 and 6, these orifices 68 of the ring may be inclined so as to direct the air 48 in a given direction inside the swirler 54.

The ring 60 is prevented from turning about its axis A relative to the bushing 62 by blocking means carried by the bushing and co-operating with the ring. By way of example, these blocking means comprise a finger carried by the bushing 62 and received in the annular groove of the bushing, said finger serving to co-operate by shape co-operation with a notch 90 (FIG. 4) of complementary shape in the annular rim 66 of the ring 60. The ring 60 is always mounted to be slidable in the radial direction in the groove of the bushing 64.

Preventing the ring 60 from moving in rotation relative to the bushing 64 makes it possible to ensure that the orifices 68 of the ring conserve the same relative positions relative to the vanes of the primary swirler 54 in operation.

The diameter of the orifices 68 is determined as a function of the thickness of material between the outlets from the channels in the swirler 54, i.e. the thickness of the trailing edges 84 of the vanes of the swirler 54. This thickness measured in the transverse or circumferential direction is greater than the diameter of the orifices 68, and preferably lies in the range about 1.5 to 2 times the diameter of said orifices. The diameter of the orifices 68 in the ring lies in the range 0.2 mm to 2 mm, e.g. in the range 0.5 mm to 1 mm.

Figure 5:
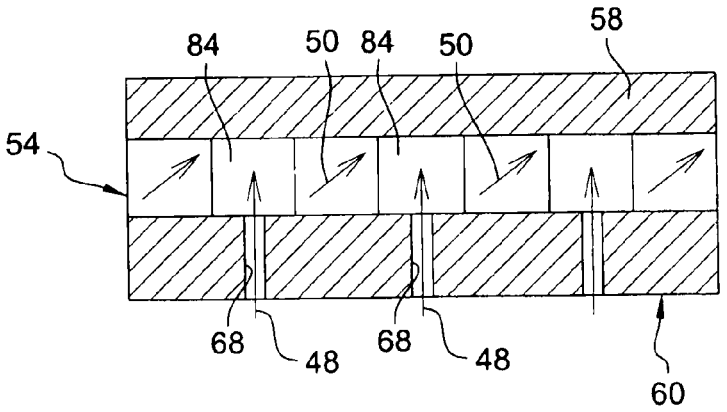
FIGS. 5 and 6 are fragmentary and highly diagrammatic views in axial section showing various embodiments of devices of the invention.
Figure 6:
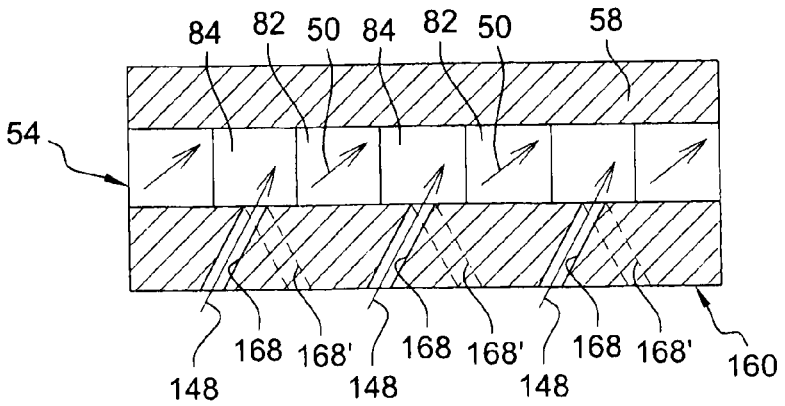

FIGS. 5 and 6 are highly diagrammatic section views of various embodiments of the device of the invention, the section being on line V-V of the device (see FIG. 2 where the line is positioned relative to a prior art device).

In the example shown in FIG. 5, the orifices 68 of the ring are substantially parallel to the axis A of the ring 60 and of the injector device 34. In the example of FIG. 6, the orifices 168 and 168' of the ring 160 are inclined relative to the axis of the ring in a tangential or circumferential direction so that the air streams 148 passing through these orifices are oriented in the direction of rotation of the air streams 50 delivered by the swirler 54 (as applies to the orifices 168 shown in continuous lines), or in the opposite direction (as applies to the orifices 168' shown in discontinuous lines).

The orifices 68, 168, 168' of the ring 60, 160 may also be inclined in a radial direction so as to converge or diverge towards one another going from upstream to downstream.

The invention claimed is:

1. A device for injecting a mixture of air and fuel into a turbomachine combustion chamber, the device comprising:

a centering ring for centering a fuel injector, the centering ring including an axial orifice receiving the fuel injector;

a Venturi situated downstream from the fuel injector and coaxially therewith; and a primary swirler situated between the centering ring and the Venturi, the swirler including substantially radial vanes defining curved air-passing channels between one another, and the ring including substantially axial air-passing orifices opening out radially inside the swirler, wherein a number of air-passing orifices in the ring is no greater than a number of vanes in the swirler, and downstream outlets of the air-passing orifices in the ring are situated between the channels of the swirler so that air streams leaving the air-passing orifices in the ring do not disturb air streams delivered by the swirler;

wherein each of the air-passing orifices opens out into a zone defined by a first plane tangential to a pressure side of the vane of the swirler and a second plane tangential to a suction side of the vane of the swirler.

2. A device according to claim 1, wherein the number of air-passing orifices in the ring lies in a range of 6 to 18.

3. A device according to claim 1, wherein the air-passing orifices in the ring have a diameter in a range of 0.2 mm to 2 mm.

4. A device according to claim 1, wherein the thickness of material in a transverse or circumferential direction between the outlets of the channels in the swirler is greater than the diameter of the air-passing orifices in the ring.

5. A device according to claim 4, wherein the thickness of material between the outlets of the channels lies in the range approximately 1.5 to 2 times the diameter of the air-passing orifices in the ring.

6. A device according to claim 1, wherein the air-passing orifices in the ring extend parallel to the axis of the ring or are inclined relative to the axis.

7. A device according to claim 6, wherein the air-orifices in the ring are inclined radially to converge or diverge relative to one another going from upstream to downstream.

8. A device according to claim 6, wherein the air-passing orifices in the ring are inclined in a tangential or circumferential direction so that the air streams passing through the air-passing orifices are oriented in a same direction of rotation as the air streams delivered by the swirler, or in the opposite direction of rotation.

9. A device according to claim 1, further comprising means for preventing the ring from turning about its axis.

10. A device according to claim 1, wherein the air-passing orifices in the ring and the vanes of the swirler are distributed regularly around the axis of the ring.

11. A turbomachine, comprising a combustion chamber fitted with at least one device for injecting a mixture of air and fuel in accordance with claim 1.

12. A device according to claim 1, wherein the ring includes an annular rim extending radially outwards and the air-passing orifices are disposed in the annular rim of the ring.

13. A device according to claim 12, wherein the ring is slidably mounted in a bushing that is fastened to the primary swirler, and the rim of the ring is received in a groove of the bushing.

14. A device according to claim 1, wherein the Venturi has a substantially L-shaped cross section and includes an outer mounting rim extending radially outwards, the outer mounting rim is interposed axially between the primary swirler and a secondary swirler, the Venturi extending axially downstream inside the secondary swirler and separates air flow coming from the primary and second swirlers.

15. A device according to claim 14, wherein the Venturi has an inside cylindrical surface presenting a throat and defining a pre-mixing chamber in which a fraction of fuel injected from the fuel injector mixes with an air stream delivered by the primary swirler.

16. A device according to claim 14, wherein a downstream end of the Venturi is connected to a mixer bowl that is axially mounted in an opening of an end wall of the combustion chamber.

* * * * *

UNITED STATES PATENT AND TRADEMARK OFFICE

CERTIFICATE OF CORRECTION

PATENT NO. : 8,590,312 B2
APPLICATION NO. : 13/143357
DATED : November 26, 2013
INVENTOR(S) : Denis Jean Maurice Sandelis It is certified that error appears in the above-identified patent and that said Letters Patent is hereby corrected as shown below:

In the Claims

Column 6, line 10, change “air-orifices” to --air-passing orifices--.

Signed and Sealed this
Twenty-ninth Day of April, 2014

Michelle K. Lee

Michelle K. Lee
*Deputy Director of the United States Patent and Trademark Office*